United States Patent [19]

Mikas et al.

[11] Patent Number: 4,852,377

[45] Date of Patent: Aug. 1, 1989

[54] TOOL PACK

[75] Inventors: Raymond Mikas, Chicago; Robert M. Szczerba, Algonquin; Sam C. Pulciani, Norridge, all of Ill.

[73] Assignee: American National Can Company, Chicago, Ill.

[21] Appl. No.: 286,301

[22] Filed: Dec. 19, 1988

Related U.S. Application Data

[63] Continuation-in-part of Ser. No. 136,730, Dec. 22, 1987, abandoned.

[51] Int. Cl.[4] ..... B21D 22/28; B21D 37/14; B21D 37/18

[52] U.S. Cl. ..... 72/349; 72/45

[58] Field of Search ..... 72/41, 43, 44, 45, 282, 72/347, 349

[56] References Cited

U.S. PATENT DOCUMENTS

| | | | |
|---|---|---|---|
| 3,577,753 | 5/1971 | Shah et al. | 72/41 |
| 3,699,791 | 10/1972 | Eibe | 72/45 |
| 3,889,509 | 6/1975 | Miller et al. | 72/349 |
| 3,943,740 | 3/1976 | Bartenstein | 72/349 X |
| 4,223,544 | 9/1980 | Main | 72/349 X |
| 4,262,512 | 4/1981 | Maeder | 72/349 X |
| 4,300,375 | 11/1981 | Maeder et al. | 72/349 X |
| 4,538,441 | 9/1985 | Nishikawa | 72/349 |
| 4,554,815 | 11/1985 | Weishalla | 72/349 |
| 4,562,720 | 1/1986 | Nishikawa | 72/349 |

FOREIGN PATENT DOCUMENTS

| | | | |
|---|---|---|---|
| 852515 | 9/1970 | Canada | 72/349 |
| 1440828 | 6/1976 | United Kingdom | 72/349 |

*Primary Examiner*—E. Michael Combs

*Attorney, Agent, or Firm*—Wallenstein Wagner & Hattis

[57] ABSTRACT

A tool pack includes a cradle (30) that defines a space (36) into which ironing die assemblies (80, 100, 106) and a plurality of lubricating rings (78, 102, 104) each associated with an ironing ring are mounted. A lubricant manifold (152) is configured so that the lubricating rings can be manipulated into position to provide communication between the rings and the manifold. The cradle has a pair of spaced locator bars (52) exposed in the space and a cover (40) is pivotally mounted on the cradle to close an access opening and is locked by a clamp mechanism (44). The cover has deflectable metal members (62) that engage the ironing assemblies and lubricating rings and apply pressure to force the assemblies into engagement with the locator bars and also provide sealing engagement between the manifold and the lubricating rings.

18 Claims, 3 Drawing Sheets

TOOL PACK

REFERENCE TO RELATED APPLICATION

This application is a continuation-in-part application of U.S. Ser. No. 136,730, filed Dec. 22, 1987 abandoned.

TECHNICAL FIELD

The present invention relates generally to apparatus for drawing and ironing metal containers and, more particularly, to a novel tool pack for such apparatus.

BACKGROUND PRIOR ART

Various types of machines have been proposed for converting a shallow cup into a drawn and ironed container. These machines usually consist of a punch or ram which is reciprocated along a path on a frame with a plurality of ironing dies arranged along the path. Usually the plurality of ironing dies are assembled into a package that is commonly referred to as a "tool pack" and having a lubricating ring interposed between each pair of adjacent ironing dies.

A cup locator is usually positioned at the entry end to the tool pack and the cups are either gravity-fed or positively-fed to the locator where they are picked up by the moving punch and are moved through the ironing dies to reduce the thickness of the side wall of the shallow cup and increase the height thereof.

U.S. Pat. No. 3,735,629 discloses one type of drawing and ironing machine or apparatus, which consists of a redraw assembly, three ironing assemblies and a stripper assembly, all arranged along the path for a punch so that a cup can be placed on the end of the punch and then forced through the respective assemblies to decrease the wall thickness and increase the height. At the end of the stroke for the punch, a domer assembly cooperates with the end of the punch to reform the end wall and the finished container is removed from the punch by the stripper assembly while the punch is returned to its original position.

For effective and prolonged operating life, it is essential that proper alignment of the ironing dies and the ram be established and maintained at all times. Various proposals have been suggested for mounting the ironing dies, and one such type is disclosed in U.S. Pat. No. 4,300,375. In this patent, the tool pack consists of three separate modules, with each module including at least one ironing die, as well as other components, such as a lubricating ring and guide rings. In assembly of the tool pack disclosed in this patent, the first module containing the first ironing die is positioned into an opening in the frame of the tool pack while the third ironing module (that has the third ironing ring) is positioned into an opening at the opposite end and the second module with the second ironing ring is then inserted between the two.

While this arrangement has been very satisfactory in maintaining accurate alignment of the ironing rings with respect to the path of the movable punch, certain deficiencies have been noted with respect to this assembly. For example, it is well known that the first ironing ring is subjected to the most wear and must be replaced more frequently than the second and third ironing assemblies. In the tool pack disclosed in the above patent, the second ironing module must first be removed before the first module can be removed, in order to replace the first ironing ring, the entire assembly must be separated by removal of several bolts.

In view of the need for special tools and the like, replacement of an ironing die is accomplished in the tool shop, rather than at the site of the machine. Thus, this requires considerable down-time for the machine in order to replace a single ironing die. Furthermore, the respective modules are rather heavy, weighing on the order of about 60 lbs., and are difficult to manipulate in a very confined space.

Thus, there remains a need for a tool pack assembly that can maintain accurate alignment and at the same time incorporate features that allow rapid replacement of an ironing die without disturbing the remainder of the assembly.

SUMMARY OF THE INVENTION

According to the present invention, a cradle has been developed for holding the respective ironing dies of a tool pack in a fixed position with respect to the path of a moving punch and can be utilized with any wall ironers, regardless of the manufacturer. Also, a novel arrangement has been developed for supplying lubricant to lubricating rings that form part of the tool pack.

According to the present invention, a tool pack for a drawing and ironing machine includes a cradle that is open at opposite ends and has an opening leading to the space between opposite ends with closure means for the opening. A plurality of ironing die assemblies are received into the open space, which has a plurality of circumferentially-spaced locator means or bars for engagement with the ironing die assemblies. The tool pack also incorporates a plurality of lubricating rings that are interposed between the lubricating rings for lubricating the shells during the ironing process.

According to a primary aspect of the present invention, the tool pack incorporates a single manifold that supplied lubricant to all of the ironing rings and is constructed so that the ironing rings can be connected to the lubricating manifold by manipulation thereof without any mechanical connection between the manifold and the lubricating ring.

For this purpose, the manifold has a mounting surface exposed to an open space that has a plurality of outlet ports in communication with a single inlet port. Each lubricating ring has a fitting that has an inlet port extending from an exposed surface thereof and the lubricating ring can be rotated into engagement with the mounting surface of the manifold to place inlet port of the lubricating ring in communication with an outlet port on the manifold.

The locator means consists of at least two circumferentially-spaced fixed bars in the cradle and pressure-applying means carried by the closure for gripping the ironing dies and lubricating rings between the locator bars ad the pressure-applying means. In the specific embodiment illustrated, the closure is in the form of a door that is hinged along one edge to an edge of the opening and has latch means adjacent the opposite edge.

The pressure-applying means is in the form of a plurality of axially-spaced spring metal strips that have opposite ends secured to the door and an intermediate portion spaced from an adjacent surface of the door so that the spring metal strips can be deflected during closure and locking of the door to apply pressure to the edges of the ironing die assemblies and hold them in a very fixed position.

The pressure-applying means also locks the lubricating rings in a fixed position to produce sealing engagement between the exposed surface of the lubricating ring and the mounting surface of the manifold and thereby eliminate the necessity of a mechanical connection. Thus, the lubricating rings can be removed from the tool pack by manipulation without the need for making any mechanical disconnections.

In the specific illustrated embodiment, the mounting surface of the manifold is a flat surface that defines a small acute angle with respect to a plane extending tangentially to the periphery of the circular lubricating ring. The mounting surface is located in close proximity to the opening in the cradle so that the acute angle extends toward the opening.

DETAILED DESCRIPTION

Figures 1, 3, 4:
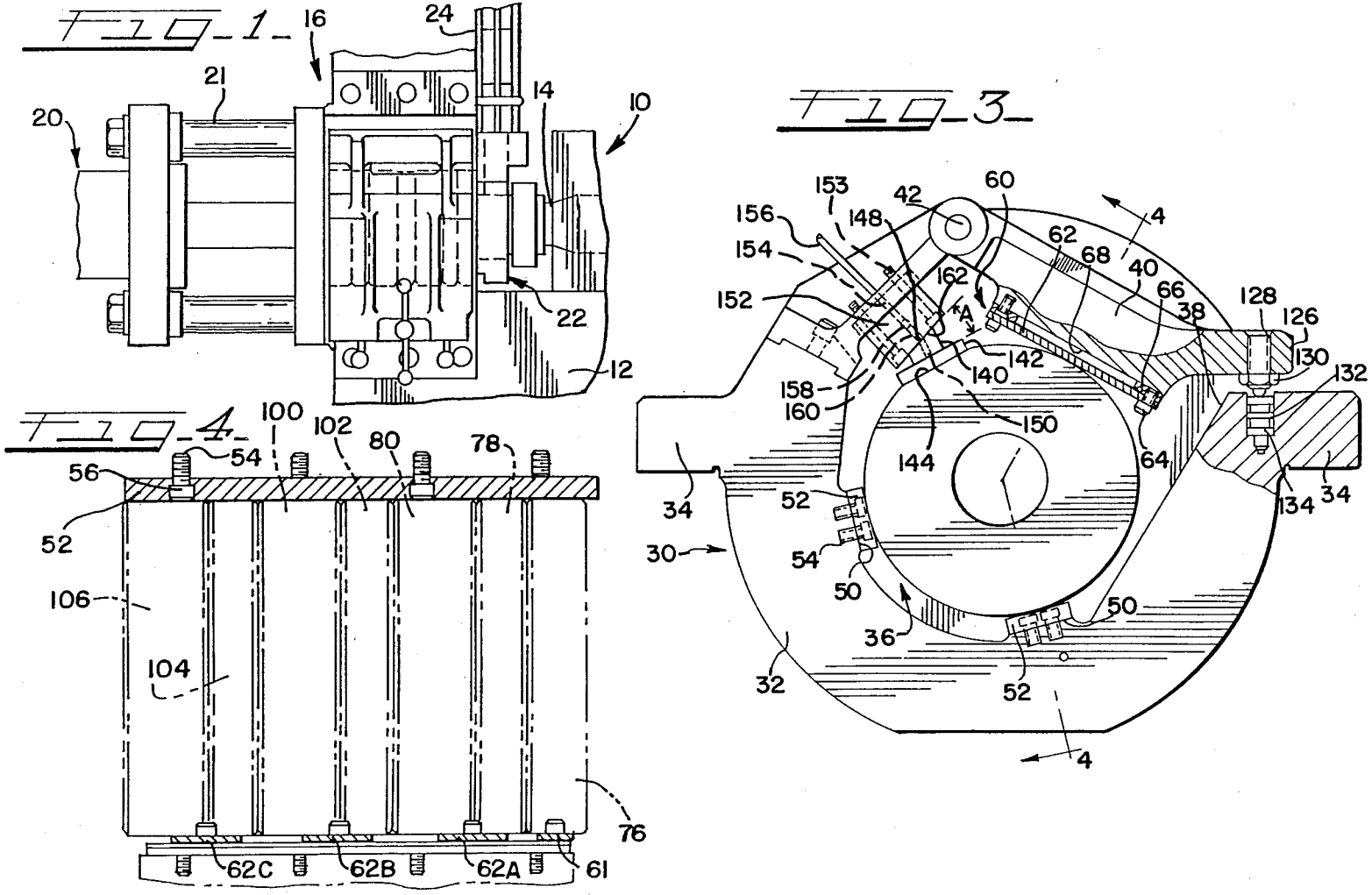
FIG. 1 of the drawings discloses a fragmentary side view of a bodymaker having the present invention incorporated therein.
FIG. 3 is an end view of the tool pack with parts thereof broken away for purposes of clarity.
FIG. 4 is a cross-sectional view, as viewed along line 4—4 in FIG. 3.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

FIG. 1 of the drawings generally illustrates a bodymaker of the type disclosed in U.S. Pat. No. 3,735,629 for forming metal container bodies. The bodymaker or machine 10 includes a frame 12 which has the various drive components for reciprocating a ram or punch 14 along a path on the frame. A tool pack assembly 16 is secured to the frame 12 and is open at opposite ends so that the punch can be reciprocated therethrough. A domer assembly 20 is supported on tension rods 21 and is located at the end of the path for moving punch 14 to reform the bottom end of the container after the drawing and ironing operation has been completed. The bodymaker 10 also has a cup locator assembly 22 located at the inlet end to the tool pack 16 with a cup feed mechanism 24 associated therewith that gravity feeds cups to the locator assembly 22 for pick up by the punch 14.

Thus, the punch picks up a cup and forces the cup through a redraw ring, a plurality of ironing rings, a plurality of lubricating rings located between respective pairs of ironing rings and a stripper assembly and cooperates with the domer assembly at the end of the stroke to reform the end wall of the container shell to a domed configuration. Thereafter, during retraction of the punch, the stripper assembly moves into the path of the free edge of the finished container to strip the container from the punch.

According to the present invention, the tool pack 16 provides a standardized method for tooling placement, controlling tolerances and allows for high-speed repeatability. The tool pack assembly 16 is designed such that individual ironing dies and lubricating rings may readily be removed without the necessity of removing any bolts or other hardware or disturbance of the remaining components of the assembly. Thus, the machine operator can easily replace an ironing die or lubricating ring in a very short period of time and will not require the assistance of a mechanic.

As shown in FIG. 3, the tool pack assembly 16 consists of a cradle 30 defined by a main body 32 that has integrally-formed mounting ears 34 at diametric locations for mounting the cradle in a fixed position on the frame 12. The cradle 30 is open at opposite ends and has a generally circular space 36 defined between the opposite ends. The cradle has an opening 38 extending to one side thereof between opposite ends and the opening 38 is closed by a closure member or cover 40. The cover or door 40 is secured to the body 32 through a hinge connection 42 adjacent one edge of the opening 38 and is secured in a closed position by a latch mechanism 44, shown in FIG. 6.

According to a primary aspect of the invention, the cradle 30 incorporates a plurality of locator means that engage and securely hold the ironing dies and lubricating rings, to be described later, in a fixed position within the cradle. Thus, as shown in FIG. 3, the space 36 has a plurality of circumferentially spaced locating surfaces 50 defined on the body 32 and exposed into the space 36. A locator bar 52 is fixedly secured to each locator surface 50 through a plurality of threaded fasteners 54. It should be noted that the threaded fasteners 54 (FIG. 4) have heads that are received into recesses 56 and alternate fasteners are respectively axially offset to one side and the other side of the center line of the bar 52, as shown in FIGS. 3 and 4.

A third locator means 60 cooperates with the door or cover 40 and is in the form of a pressure-applying means for urging the ironing dies and lubricating rings into engagement with the locator bars 52. As shown in FIGS. 3 and 4, the pressure-applying means 60 consists of a plurality of spring metal strips 61, 62 that have opposite ends secured by fasteners 64 to the door 40 with shims 66 located between the spring metal strips 62 and the adjacent mounting surface 68 of the door. Thus, the adjacent surfaces of the spring metal strips are spaced from the mounting surface 68 by a predetermined dimension to allow for deflection of the spring metal strips during closure and locking of the door, as will be explained later.

Figure 2:
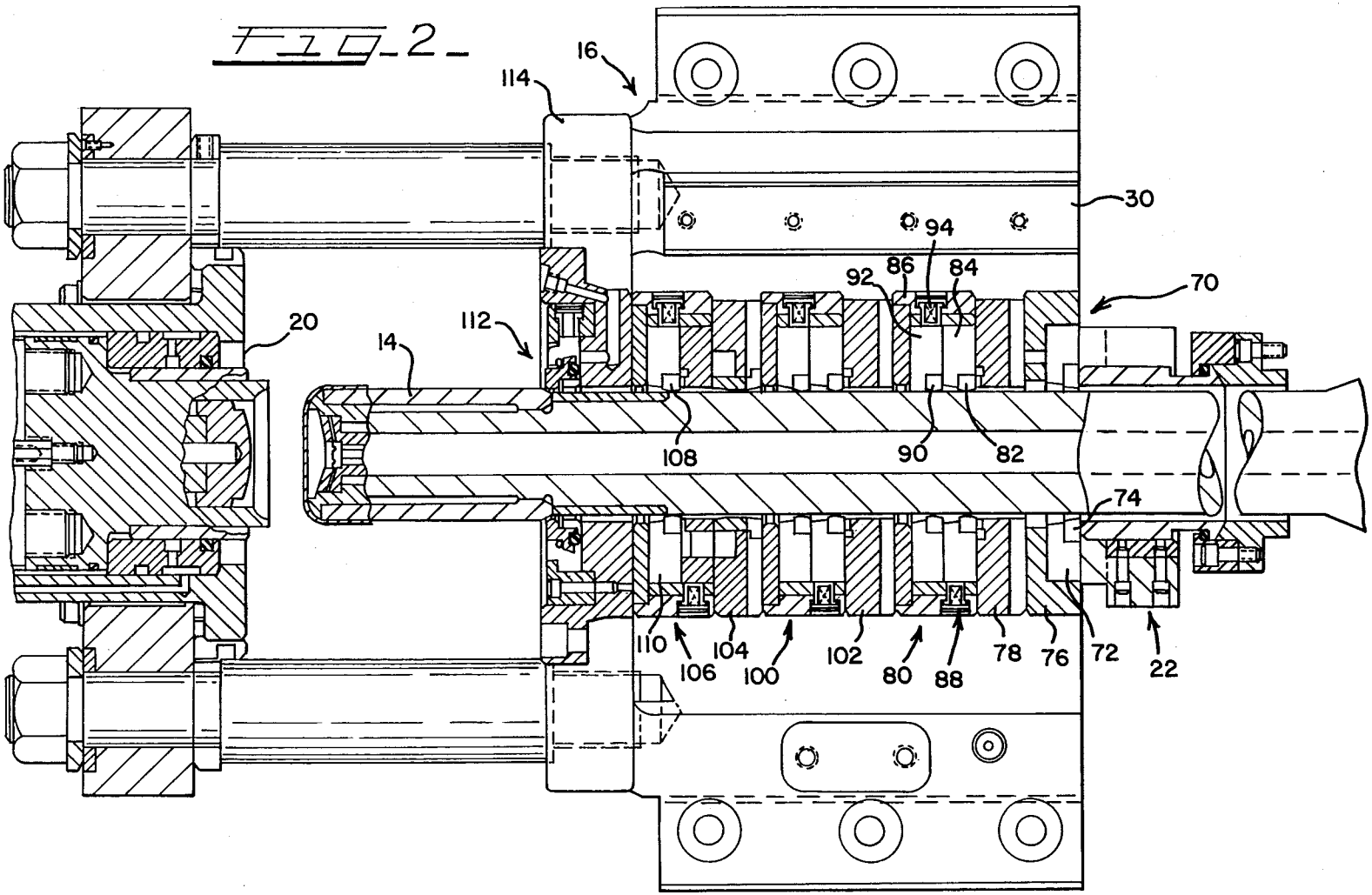
FIG. 2 is an enlarged cross-sectional view showing the details of the tool pack and the associated hardware.

FIG. 2 of the drawings shows the internal components of the tool pack and the arrangement of the components with respect to the remaining bodymaker. Thus, a redraw sleeve assembly 70 is located at the entrance end to the tool pack assembly or cradle. A redraw ring 72 having a redraw die 74 is supported on a support ring 76 and is positioned against a lubricating ring 78. The lubricating ring is located downstream of the redraw ring for directing lubricant to the surface of the cup as it is moved through the ironing dies in a manner that is well known in the art.

A first ironing assembly 80 is located downstream of the lubricating ring 78 and includes an ironing die 82 supported in a ring 84 that is mounted in a carrier 86 and is biased to a centered position by a plurality of circumferentially-spaced biasing means 88. The first ironing assembly also includes a guide die 90 that is carried on a ring 92 and is centered through a plurality of centering springs 94.

A second ironing die assembly 100 includes the same components as the first ironing die assembly 80 except that the internal diameters of the ironing die and the guide die are somewhat smaller. A second lubricating ring 102 is located between the first ironing assembly 80 and the second ironing assembly 100.

A third lubricating ring 104 is located between the second ironing die assembly 100 and a third ironing die assembly 106. The third ironing die assembly has a third ironing die 108 supported in a ring 110 and also centered through a biasing means.

The remainder of the components include a stripper assembly 112 mounted on a plate 114 that forms part of the frame 12 and the domer assembly 20. The domer assembly 20 may be of the type disclosed in U.S. Pat. No. 4,620,434, incorporated herein by reference, while the stripper assembly could be of the type disclosed in U.S. Pat. No. 4,324,124, incorporated herein by reference. Both of these patents are assigned to the Assignee of the present invention.

According to the primary aspect of the present invention, each lubricating ring 78, 102 or 104 can be inserted and placed in communication with a lubricant source without making a physical connection therewith. Thus, as shown in FIG. 3, each lubricating ring has a fitting 140 which has a mounting flange 142 engaging a flattened surface 144 on the lubricating ring and is connected by bolts 146. The fitting 140 has an exposed surface 148 which has an inlet port 150 extending therethrough.

The lubricant supply means consists of a manifold 152 that is secured by bolts 153 to the main body 32 adjacent the opening 38 and has an inlet port 154 with a flexible lubricant supply conduit 156 connected thereto. The inlet port is in communication with an axial distribution port 158 which has a plurality of outlet ports 160 extending through an inclined mounting surface 162. The mounting surface 162 defines a small acute angle A with respect to the surface 144 which defines a tangential plane on the periphery of the lubricating ring. The mounting surface 162 is exposed towards the opening 38.

Figure 6:
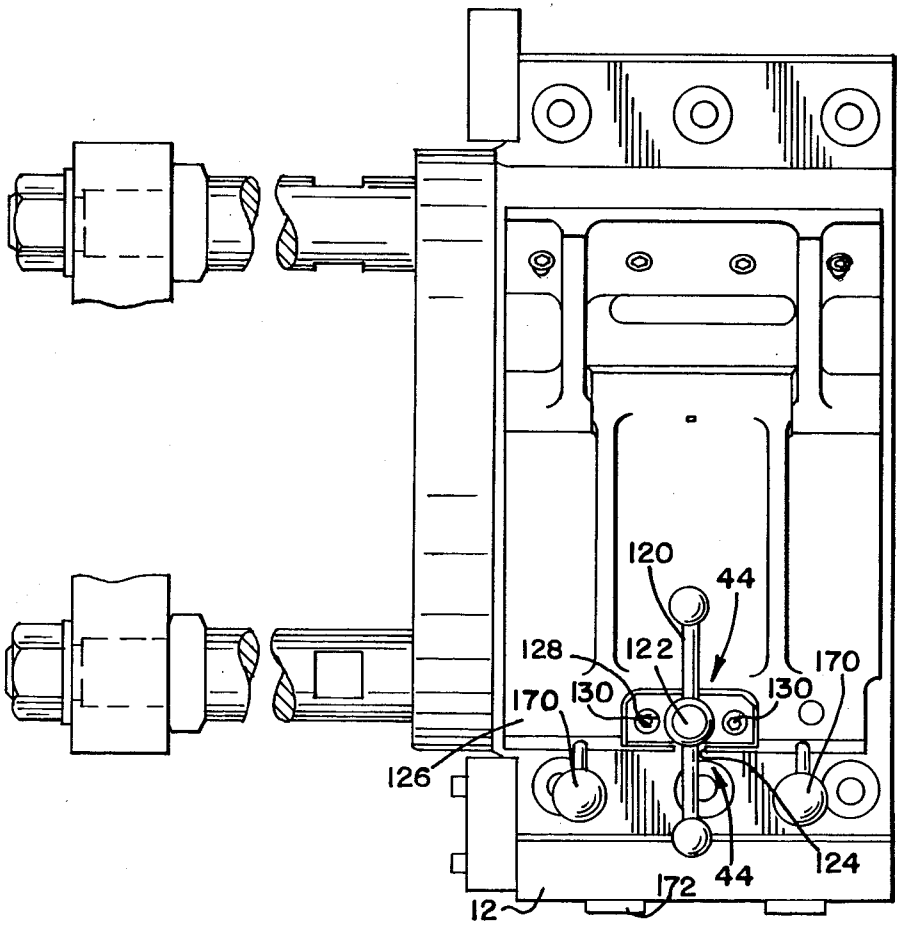
FIG. 6 is an enlarged side view of the tool pack of the present invention in its assembled condition in the bodymaker.
Figure 5:
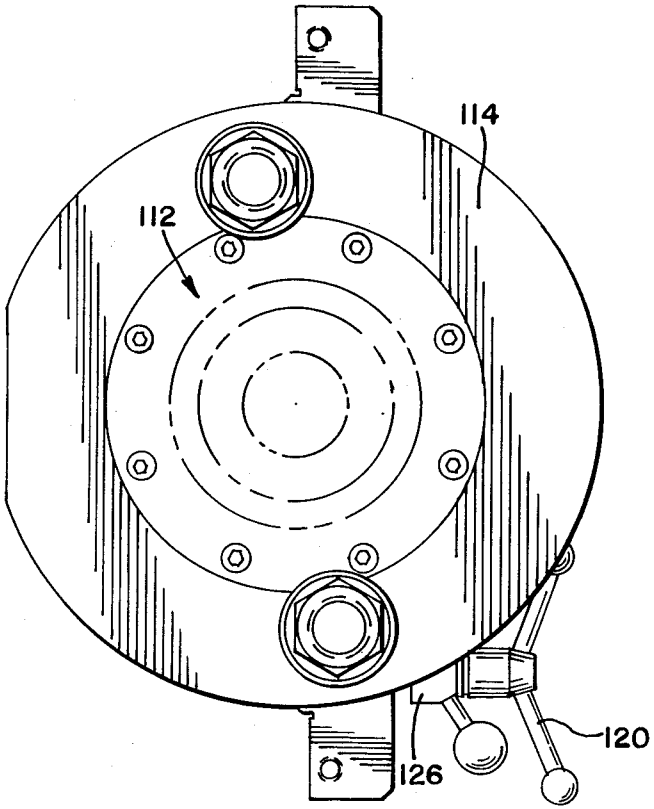
FIG. 5 is an end view of the opposite end of the tool pack.

Before describing the assembly and merits of the invention, a few additional details need to be described. For example, the locking means 44 is shown in FIG. 6 and includes a crank 120 that is mounted on a threaded fastener 122 which is pivotedly-mounted on the body 32 of the cradle 30. The fastener or threaded member 122 is adapted to be received into a slot 124 that is defined on a flange 126, which forms part of cover or door 40. In addition, the mounting flange 126 has a pair of openings 128 (FIG. 3) which receive adjustable stops 130 while the mounting ear 34 has a recess 132 for receiving a cooperating adjustable element 134. Thus, the closed locked position for the cover can readily be adjusted. In order to aid in opening and closing the door, a pair of knobs 170 extend from the mounting flange 126.

In assembling the components, the cradle 30 is configured such that the ears 34 are in engagement with the fixed frame structure. The body 32 is configured such that the locator bars 52 are located adjacent the lower portion of the space while the door is adjacent the upper end of the assembly. To accurately position the cradle 30, adjustment screws 172 (FIG. 6) are provided on the frame 12.

After the cradle has been properly secured in position within the bodymaker, the various components, including the redraw assembly 76, the first lubricating ring 78, the first ironing assembly 80, the second lubricating ring 102, the second ironing assembly 100, the third lubricating ring 104, and the third ironing assembly 106 are sequentially installed into the open space and rest on the locator bars 52. Each lubricating ring 78, 102, 104 is placed on the locator bars 52 and is then rotated to place its exposed surface 148 into extended surface contact with mounting surface 162 of manifold 152 to place its inlet port 150 in communication with an outlet port 160 in manifold 152.

The respective steel straps 61, 62A, 62B, 62C are positioned to respectively engage separate components. Thus, the narrower metal strap 61 engages the redraw assembly 76, while the strap 62A engages the first lubricating ring and the first ironing assembly 80, as shown in FIG. 4. The second metal strap 62B engages the second ironing assembly 100 and the second lubricating ring 102, while the third metal strap 62C engages the third lubricating ring 104 and the third ironing assembly 106. Thus, when the lever 120 is rotated to lock the door in a closed position, the respective metal straps are deflected and apply pressure to the surface of the respective assemblies, forcing the assemblies into engagement with the respective locator bars 52. At the same time, the flexible spring metal straps 62 apply a sealing pressure with respect to the exposed surface 148 of each lubricating ring and the mounting surface 162 of the manifold 152 and eliminates the need for any mechanical connection. Thus, the lubricating rings can easily and quickly be removed after the door is opened without making a mechanical disconnection from the lubricant supply source.

It should be noted that with the fasteners 54 offset from the center of the bar, the point of engagement between the assemblies and the bars is between the respective fasteners and, therefore, a continuous surface contact is maintained throughout the length of the bar by the respective assemblies.

Thus, replacement of one or more ironing assemblies or lubricating rings becomes a very simple task that can be performed by the machine operator. The operator rotates the crank 120 to unlock the door and the latch mechanism 44 is pivoted out of slot 124. The door is then opened and the selected ironing die assembly or lubricating ring is remove and replaced with a new assembly. It should be noted that no bolts need to be removed and the lubricant supply means does not need to be disturbed.

With the structure described above, accurate alignment can easily be attained to maintain the tight manufacturing tolerances resulting from the high-speed production and decrease in metal thickness for the containers that are produced by the bodymaker. Furthermore, the same cradle structure can be used to draw and iron containers of different diameters by proper sizing of the openings in the assemblies.

It should be noted that the cradle 30 is designed to receive a tool pack having a peripheral diameter of about 7.5 inches, which is a relatively standard size for assemblies of this type. However, in the event a smaller diameter assembly is used, such as a 6.5 inch peripheral diameter tool pack assembly, the smaller size can readily be accommodated by changing the locator bars and the position of the metal strips so that the smaller diameter assembly can be accommodated in the same cradle assembly. It should also be noted that different bodymakers, such as those manufactured by Standun, Inc. or those manufactured by Ragsdale, may require a different positioning of the mounting ears 34 to accommodate the different structures.

Of course, it will be appreciated that, while spring steel straps have been shown as the pressure-applying means, other members could be utilized.

While the specific embodiments have been illustrated and described, numerous modifications come to mind without significantly departing from the spirit of the invention and the scope of protection is only limited by the scope of the accompanying claims.

We claim:

1. A tool pack for a drawing and ironing machine comprising a cradle having an opening with closure means for said opening, said cradle defining an open space therein open at opposite ends for receiving a plurality of ironing dies with a plurality of lubricating rings interposed between respective adjacent pairs of ironing dies, a plurality of circumferentially-spaced locator means exposed in said space for engagement with said ironing dies, a manifold fixed in said cradle and having a mounting surface exposed to said open space, said manifold having a single inlet port and a plurality of outlet ports equal in number to said lubricating rings and extending through said mounting surface, each of said lubricating rings having a fitting having an exposed surface with an inlet port extending through said exposed surface so that said lubricating ring can be rotated on said locator means to produce extended surface contact between said exposed surface and said mounting surface and align said inlet port of said lubricator ring with an outlet port of said manifold, at least one of said locator means being deflectable to apply pressure to said ironing dies and lubricating rings and maintain accurate alignment of said ironing dies and lubricating rings with respect to a punch movable therethrough while producing sealing engagement between said mounting surface and said exposed surfaces.

2. A tool pack as defined in claim 1, in which said locator means includes at least two circumferentially spaced bars extending substantially the length of said cradle.

3. A tool pack as defined in claim 1, in which said one of said locator means includes a plurality of deflectable spring steel members secured at opposite ends on said closure means.

4. A tool pack as defined in claim 1, in which said closure means includes a door pivoted along one edge of said opening and in which said one of said locator means is carried by said door.

5. A tool pack as defined in claim 4, in which said one of said locator means includes a plurality of resilient strips having opposite ends connected to said door with intermediate portions spaced from an adjacent surface of said door.

6. A tool pack as defined in claim 5, in which said locator means include at least two locator bars circumferentially spaced from each other and spaced from said door.

7. A tool pack as defined in claim 6, further including latch means between said door and said cradle for applying pressure to and thereby deflecting said resilient strips.

8. A tool pack as defined in claim 1, in which said mounting surface defines a small acute angle with respect to a tangential plane on the periphery of said lubricating ring.

9. In a drawing and ironing machine having a punch movable along a path through a plurality of ironing dies, a tool pack comprising a cradle open at opposite ends and having an opening between opposite ends with closure means for said opening pivoted along one edge of said opening and a plurality of circumferentially-spaced locator means extending between said opposite ends, said ironing dies engaging said locator means and having a lubricating ring located between each adjacent pair of ironing dies, a lubricant supply manifold fixed to said cradle and having a flat mounting surface with a plurality of outlet ports leading from a single inlet port, each lubricating ring having a fitting with an inlet port extending from a flat exposed surface so that said exposed surface can be rotated into engagement with said mounting surface and place said inlet port in communication with an outlet port in said manifold, and pressure applying means carried by said closure means for gripping said ironing dies and said lubricating rings between said locator means and said pressure applying means to accurately align said ironing dies with respect to each other and produce sealing engagement between said exposed surfaces of said lubricating rings and said mounting surface of said manifold.

10. A drawing and ironing machine as defined in claim 9, in which each locator means includes a continuous locator bar extending axially of said path.

11. A drawing and ironing machine as defined in claim 10, in which said pressure applying means includes a plurality of spring metal strips extending transversely of said path and having opposite ends secured to said closure means, said metal strips being spaced from an adjacent surface of said closure means so as to be deflectable when said closure means is placed in a closed position.

12. A drawing and ironing machine as defined in claim 11, further including lock means for applying pressure to said metal strips and thereby deflect said metal strips.

13. A drawing and ironing machine as defined in claim 9, in which each lubricating ring has a flat surface extending tangentially thereof with said fitting secured thereto and said exposed surface of said fitting and mounting surface of said manifold defining a small acute angle with respect to said flat surface which opens toward said opening in said cradle.

14. A tool pack comprising a cradle that is open at opposite ends and has an opening between opposite ends with a door pivoted on said cradle to close said opening for gaining access to a space defined between said opposite ends, locator means in said space opposite said opening, said locator means comprising at least two circumferentially spaced locator bars extending between said opposite ends, a plurality of ironing die assemblies located in said space and engaging said locator bars, a plurality of circular lubricating rings respectively interposed between adjacent pairs of ironing dies and engaging said locator bars, each lubricating ring having a flat surface defining a tangential plane on a periphery thereof with a fitting secured to said flat surface and having a flat exposed surface inclined with respect to said flat surface and an inlet port therein, a manifold having a plurality of outlet ports extending through a mounting surface which is in extended engagement with said flat exposed surface, and pressure applying means carried by said door for forcing said ironing die assemblies and lubricating rings into engagement with said locator bars for maintaining said ironing assemblies in fixed positions within said cradle while applying a sealing force between each exposed surface of each lubricating ring and said mounting surface of said manifold when said door is in its closed position.

15. A tool pack as defined in claim 14, in which said pressure applying means includes deflectable members engaging said ironing assemblies.

16. A tool pack as defined in claim 15, in which said deflectable members include a plurality of metal straps extending parallel to opposite ends of said cradle and having opposite ends secured to said door and intermediate portions spaced from said door to accommodate deflection.

17. A tool pack as defined in claim 16, further including clamp means between said door and said cradle for applying pressure to and thereby deflecting said metal straps.

18. A tool pack as defined in claim 14, further including a redraw die assembly at the entrance end of said space with a first lubricating ring between said redraw die assembly and in which there are at least three ironing assemblies and two additional lubricating rings sequentially positioned between said ironing assemblies, each of said metal straps engaging one ironing assembly and one lubricating ring.

* * * * *